US005587018A

United States Patent [19]

Chung

[11] Patent Number: 5,587,018

[45] Date of Patent: Dec. 24, 1996

[54] 360 DEGREES FAST SPOT GLUING MACHINE FOR SCREWS

[75] Inventor: Fa-Chih Chung, Miao-Li Hsien, Taiwan

[73] Assignee: Jiuh Yih Hardware Co., Ltd., Miao-Li Hsien, Taiwan

[21] Appl. No.: 375,676

[22] Filed: Jan. 20, 1995

[51] Int. Cl.[6] ..... B05C 11/00; B05C 1/00; B05C 5/00

[52] U.S. Cl. ..... 118/679; 118/686; 118/232; 118/264; 118/266; 118/322; 118/324

[58] Field of Search ..... 118/232, 264, 118/266, 322, 324, 679, 686

[56] References Cited

U.S. PATENT DOCUMENTS

| | | | |
|---|---|---|---|
| 3,344,769 | 10/1967 | Williams | 118/324 X |
| 3,416,492 | 12/1968 | Greenleaf | 118/308 X |
| 3,452,714 | 7/1969 | Burke et al. | 118/308 X |
| 3,795,224 | 3/1974 | Batson et al. | 118/308 |
| 4,353,325 | 10/1982 | Argazzi | 118/683 |
| 4,508,759 | 4/1985 | Wallace | 118/322 X |

FOREIGN PATENT DOCUMENTS 131408 1/1985 European Pat. Off. .

1022747 6/1983 U.S.S.R. .

*Primary Examiner*—Arlen Soderquist
*Attorney, Agent, or Firm*—Bacon & Thomas

[57] ABSTRACT

A fast spot gluing machine for screws is disclosed, having a vibrating body, a horizontal conveyor, a support board, a rubber wheel, a spot gluing plate, a speed-adjustable motor, a control circuit and a glue compressor. A spiral slope is disposed on an inner wall of the vibrating body, extending to a top of the vibrating body to connect with the horizontal conveyor. The support board is disposed at a rear portion of the horizontal conveyor and includes a base board and first and second upright boards. The control circuit is used to control rotational speed of the motor. The motor has a rotary shaft on which the rubber wheel is fitted. The first upright board is formed with an arcuate notch for partially receiving the rubber wheel and the second upright board is formed with an elongated adjusting slot. An adjusting screw formed with a through hole is disposed through elongated slot to engage the spot gluing plate. A glue injecting nozzle is connected to a rear end of the adjusting screw, such that the glue compressor can compress and feed the glue through the through hole of the adjusting screw so as to be sprayed onto the spot gluing plate, when the screws are conveyed by the conveyor to a position between the rubber wheel and the spot gluing plate, the rubber wheel rotates to make the stem portion of the screw entirely roll over the spot gluing plate.

4 Claims, 7 Drawing Sheets

360 DEGREES FAST SPOT GLUING MACHINE FOR SCREWS

BACKGROUND OF THE INVENTION

The present invention relates to a fast spot gluing machine for screws, which is able to entirely spot glue the screws at increased speed.

FIGS. 1 and 2 show a conventional spot gluing machine for screws, having a vibrating body 10, a rectangular guide tube 20, a U-shaped fixing support 30, first and second gears 41, 42 opposite to each other, a stepped motor 50, a control circuit 60 and a glue compressing device 70. A spiral slope 11 is formed on an inner wall of the vibrating body 10, extending to a top thereof to connect with the guide tube 20. The guide tube 20 extends downward to a lower end and is formed with a lengthwise channel 21. The U-shaped support 30 fixedly retains the lower end of the guide tube 20 between the two gears 41, 42 and has two parallel arms 31, 32 formed with slots 311, 321 respectively. A glue injecting nozzle 71 is disposed above the second gear 42, whereby the glue compressing device 70 can compress and feed the glue to the nozzle 71 so as to be sprayed into the clearances between the teeth of the gear 42. The control circuit 60 is disposed behind the gears 41, 42 for controlling the stepped motor 50 to intermittently rotate the gears 41, 42.

Please refer to FIG. 3 which shows the operation of the conventional machine according to FIGS. 1 and 2. The screws to be glued are first placed into the vibrating body 10 which vibrates to make the screws move upward along the spiral slope 11 into the guide tube 20. The stem portion of each screw protrudes outside the guide tube 20 through the channel 21 thereof, while the head portion of the screw is restrained by the edge of channel 21 to move downward along the guide tube 20. The glue compressing device 70 operates synchronously with the stepped motor 50, whereby when the gears 41, 42 stop rotating, the glue compressing device 70 sprays the glue into the clearances between the teeth thereof. The screw sliding downward along the guide tube 20 will reach a position between the gears 41, 42 in a horizontal state and automatically drop into the clearance sprayed with the glue to be spot glued. When the two gears 41, 42 perform the next rotation, the spot glued screw automatically drops onto a conveying belt 80 disposed under the gears 41, 42. The same procedure is repeated continuously.

According to the above arrangements, three shortcomings exist as follows:

1. The screw is spot glued in cooperation with the intermittent rotation of the gears 41, 42 so that the spot gluing operation is performed at a low rate.

2. The two gears 41, 42 are fixedly disposed and unadjustably used only for screws having dimensions within a specific range.

3. The spot gluing cannot be applied to the entire surface of the stem portion of the screw and is applied only to a very small area of the stem portion of the screw, which is at most about 45 degrees of the surface of the stem portion. Therefore, the screw going through such spot gluing has relatively poor quality.

It is therefore necessary to provide an improved spot gluing machine for screws, which is able to continuously entirely spot glue different screws with various dimensions around 360 degrees of the surface and at increased speed.

SUMMARY OF THE INVENTION

It is therefore a primary object of the present invention to provide a gluing machine for screws, which is able to continuously and entirely spot glue 360 degrees of the surface of the screws at increased speed.

It is a further object of the present invention to provide the above spot gluing machine which includes two upright boards the distance between which is adjustable to suit screws with different dimensions.

It is still a further object of the present invention to provide the above spot gluing machine which is able to spot glue the entire surface of the screws so as to ensure the quality and effect of the screws.

According to the above objects, the 360 degrees fast spot gluing machine of the present invention comprises a vibrating body, a horizontal conveying means, a support board, a rubber wheel, a spot gluing plate, a speed-adjustable motor, a control circuit and a glue compressing means. A spiral slope is disposed on an inner wall of the vibrating body, extending to a top of the vibrating body to connect with the horizontal conveying means. The support board is disposed at a rear portion of the horizontal conveying means and includes a base board, and first and second upright boards. The control circuit is used to control rotational speed of the motor. The motor has a rotary shaft on which the rubber wheel is fitted. The first upright board is formed with an arcuate notch for partially receiving the rubber wheel and the second upright board is formed with an elongated adjusting slot, whereby an adjusting screw formed with a through hole can be disposed through the elongated slot to engage with the spot gluing plate. A glue injecting nozzle is disposed at a rear end of the adjusting screw, whereby the glue compressing means can compress and feed the glue through the through hole of the adjusting screw to the nozzle 81 so as to be sprayed onto the spot gluing plate. When the screws are conveyed by the conveying means to a position between the rubber wheel and the spot gluing plate, the rubber wheel rotates to make the stem portion of the screw entirely roll over the spot gluing plate. After the spot gluing operation, the screws are continuously conveyed by the conveying means to drop onto a lower conveying belt.

The present invention can be best understood through the following description and the accompanying drawings, wherein:

DETAILED DESCRIPTION OF THE PREFERRED EMBODIMENT

Figure 1:
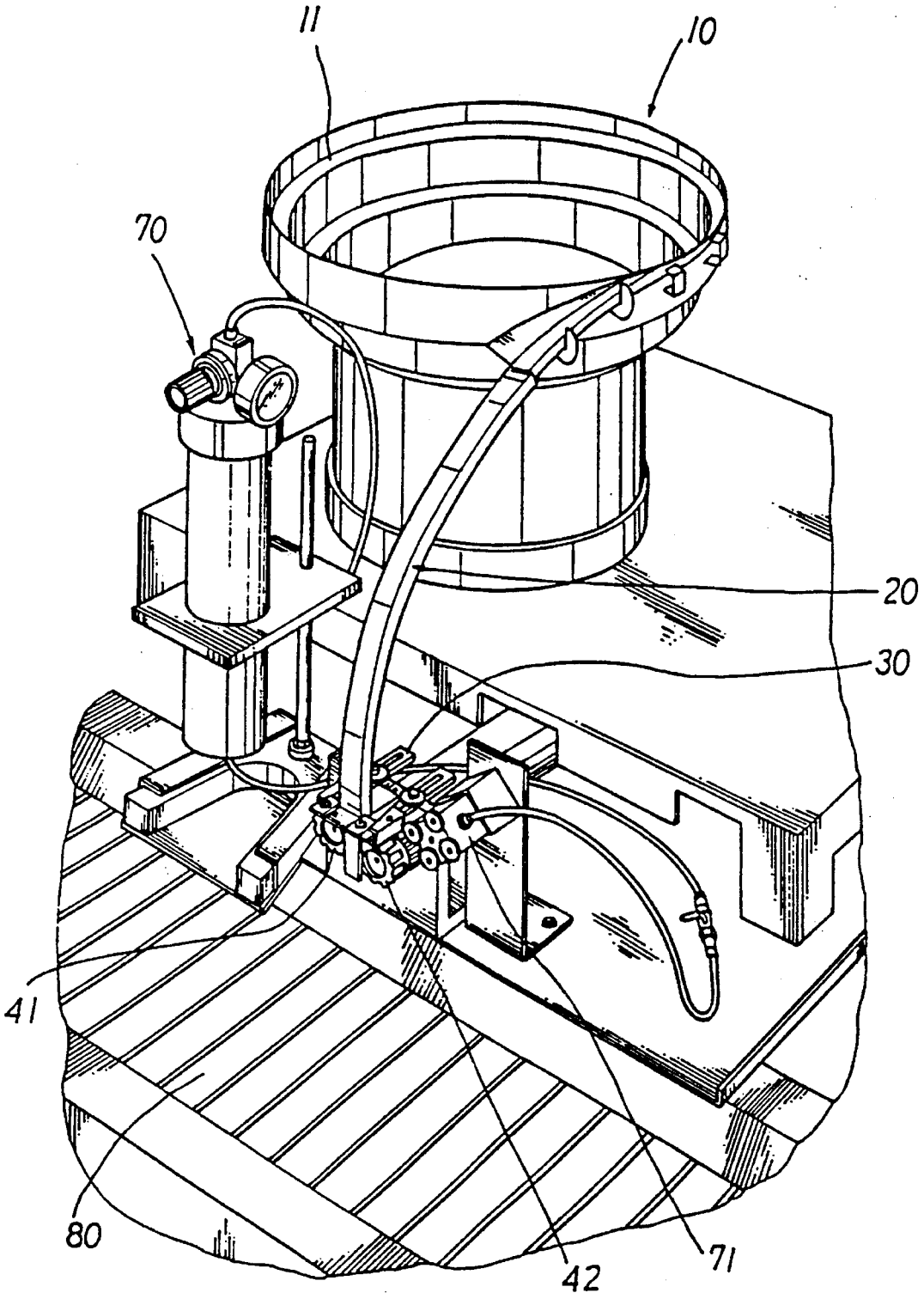
Fig. 1 (PRIOR ART)
FIG. 1 is a perspective view of a conventional spot gluing machine for screws.
Figure 2:
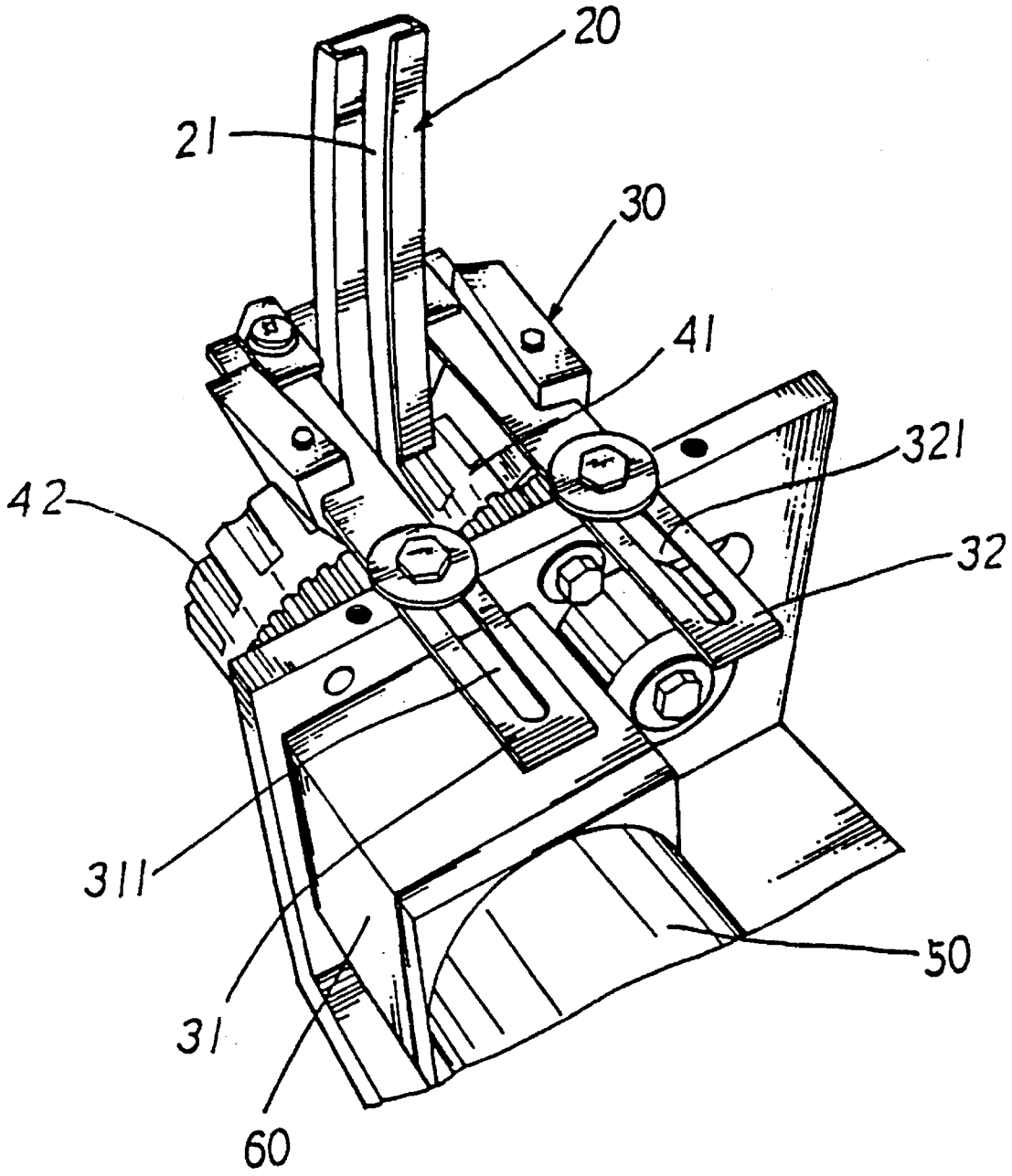
Fig. 2 (PRIOR ART)
FIG. 2 is a perspective view of a part of the conventional spot gluing machine of FIG. 1.
Figure 3:
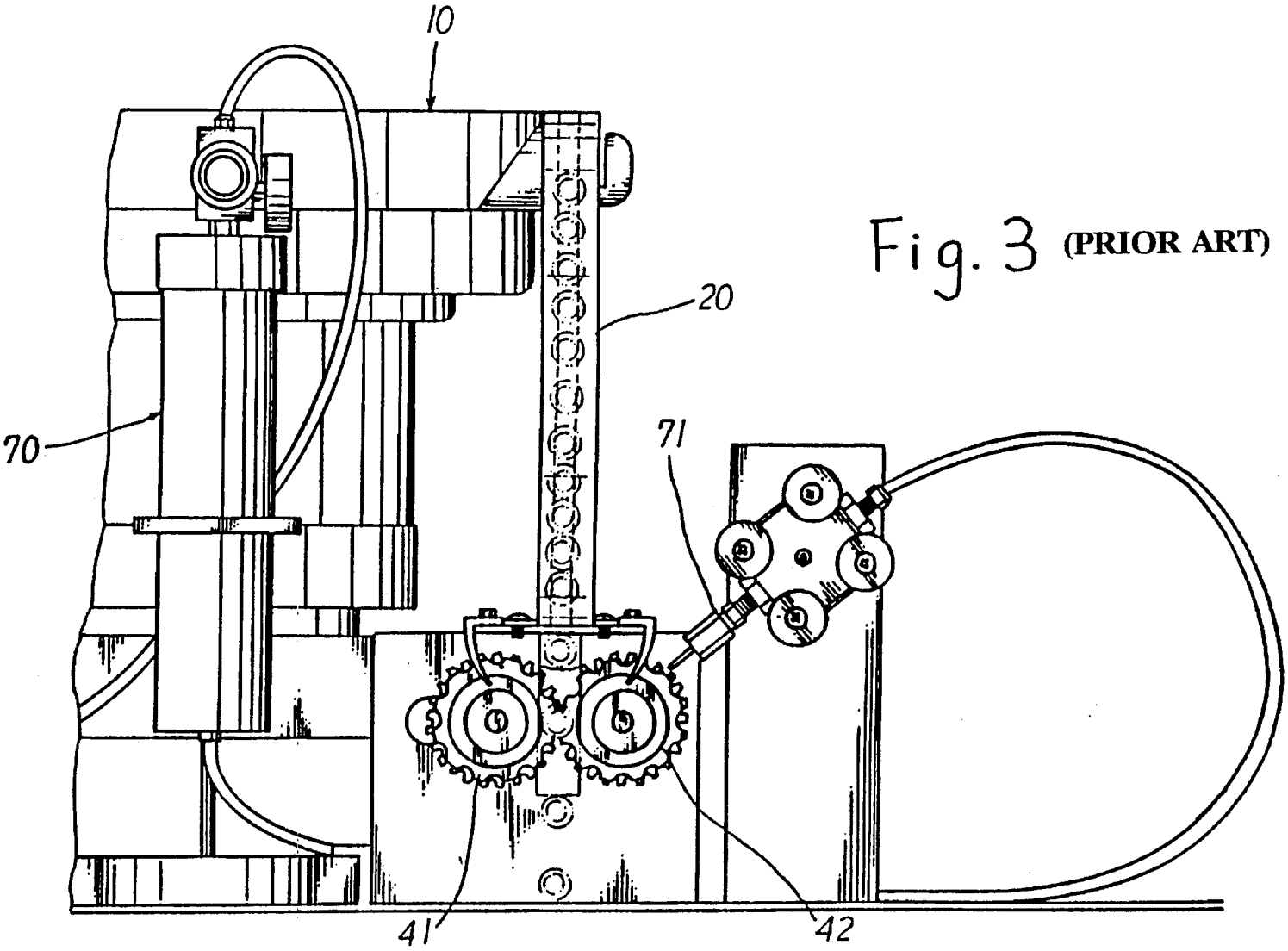
Fig. 3 (PRIOR ART)
FIG. 3 shows the operation of the conventional spot gluing machine of FIG. 1.
Figure 4:
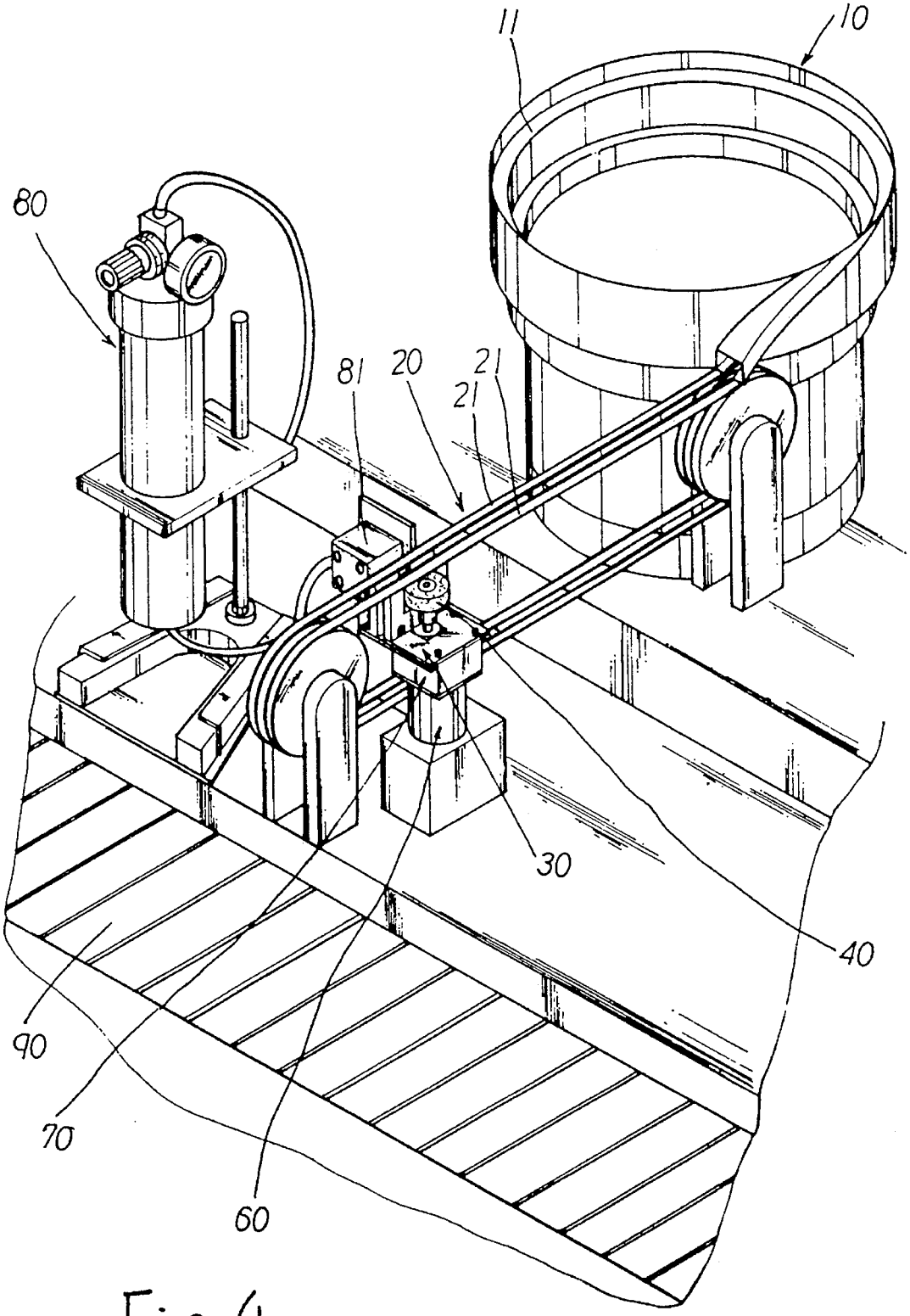
FIG. 4 is a perspective view of the spot gluing machine of the present invention.
Figure 5:
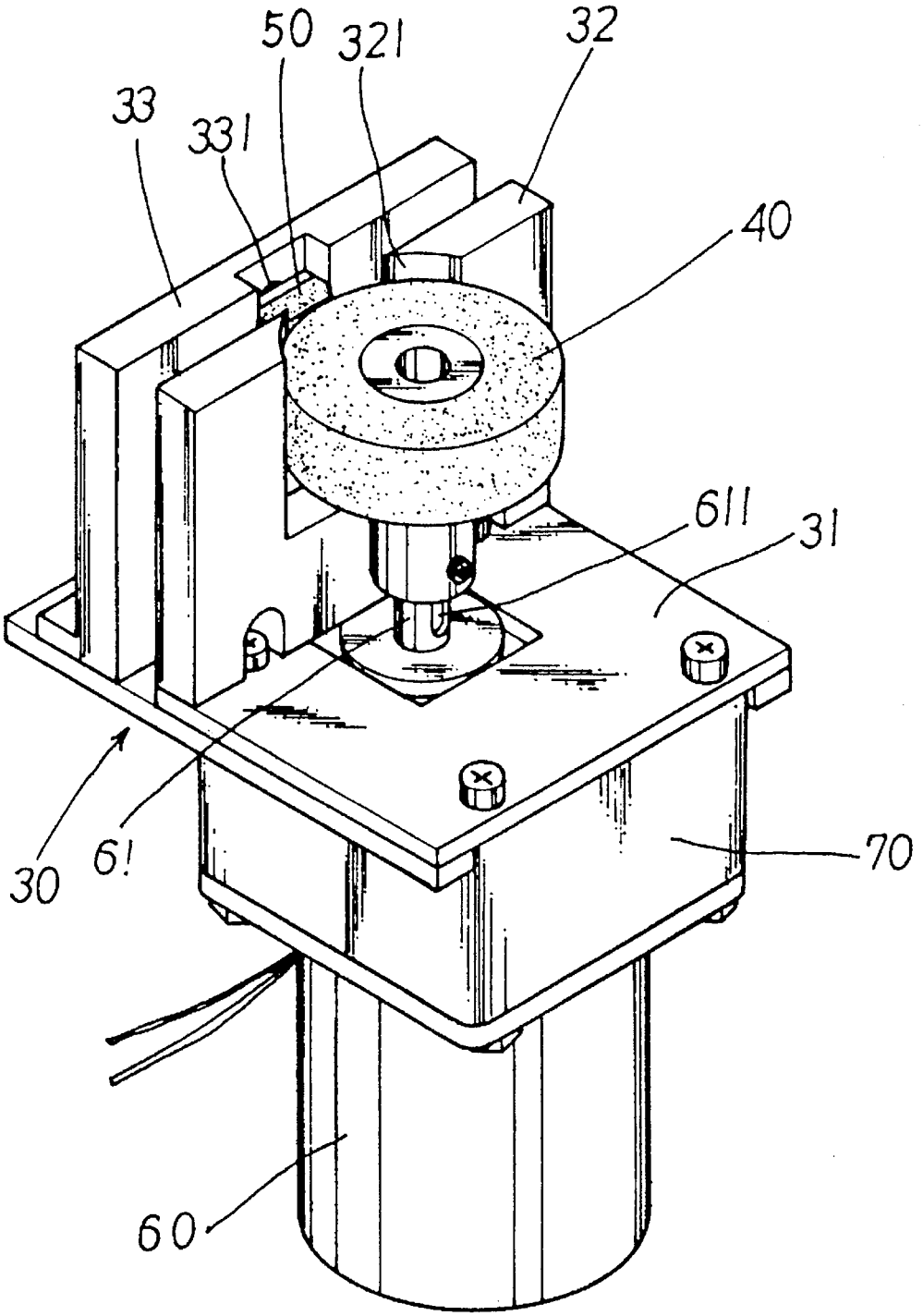
FIG. 5 is a perspective view of a part of the spot gluing machine of FIG. 4.
Figure 6:
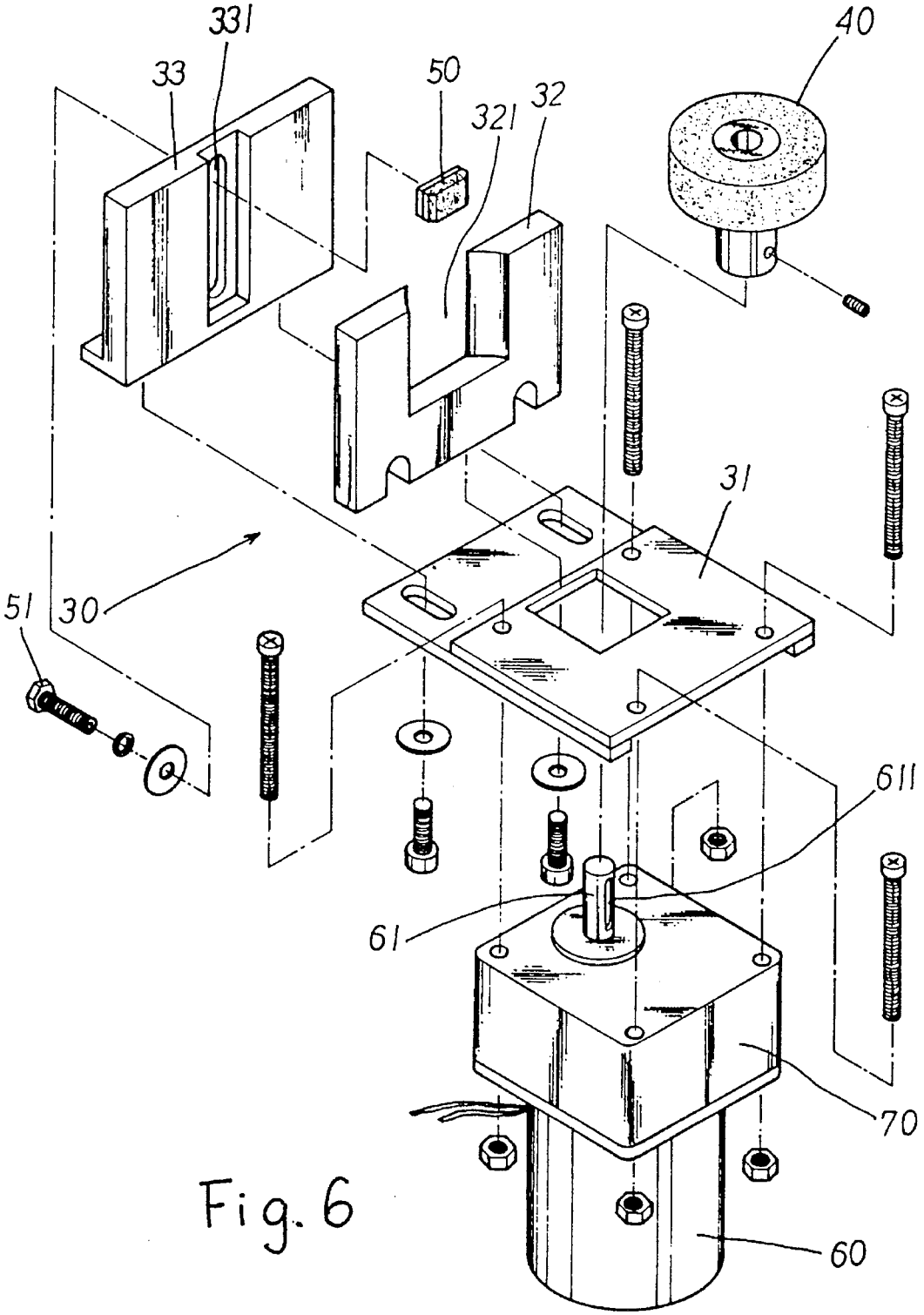
FIG. 6 is a perspective exploded view according to FIG. 5.

Please refer to FIGS. 4, 5 and 6. The spot gluing machine of the present invention includes a vibrating body 10, a horizontal conveying means 20, a support board 30, a rubber wheel 40, a spot gluing plate 50, a speed-adjustable motor 60, a control circuit 70 and a glue compressing means 80. A spiral slope 11 is disposed on an inner wall of the vibrating body 10, extending to a top thereof to connect with the horizontal conveying means 20. The horizontal conveying means 20 includes first and second horizontal conveying belts 21 which are adjustable in speed. The support board 30 is disposed at a rear portion of the horizontal conveying means 20, and includes a base board 31 and first and second upright boards 32, 33. The control circuit 70 is disposed under the base board 31 for controlling the rotational speed of the motor 60. The motor 60 has an upward extending rotary shaft 61 formed with an adjusting slot 611. The rubber wheel 40 is fitted on the rotary shaft 61 and is adjustable in height by means of the adjusting slot 611 thereof. The first upright board 32 is formed with an arcuate notch 321 for partially receiving the rubber wheel 40. The second upright board 33 is formed with an elongated adjusting slot 331, whereby an adjusting screw 51 formed with a through hole is disposed through the slot 331 to engage with the spot gluing plate 50. By means of the adjusting slot 331 the spot gluing plate 50 is adjustable in height. Moreover, the second upright board 33 is transversely adjustable to vary the distance between the first and second upright boards 32, 33. A glue injecting nozzle 81 is connected to a rear end of the adjusting screw 51, whereby the glue compressing means 80 can compress and feed the glue through the through hole of the screw 51 so as to be sprayed onto the spot gluing plate 50.

Figure 7:
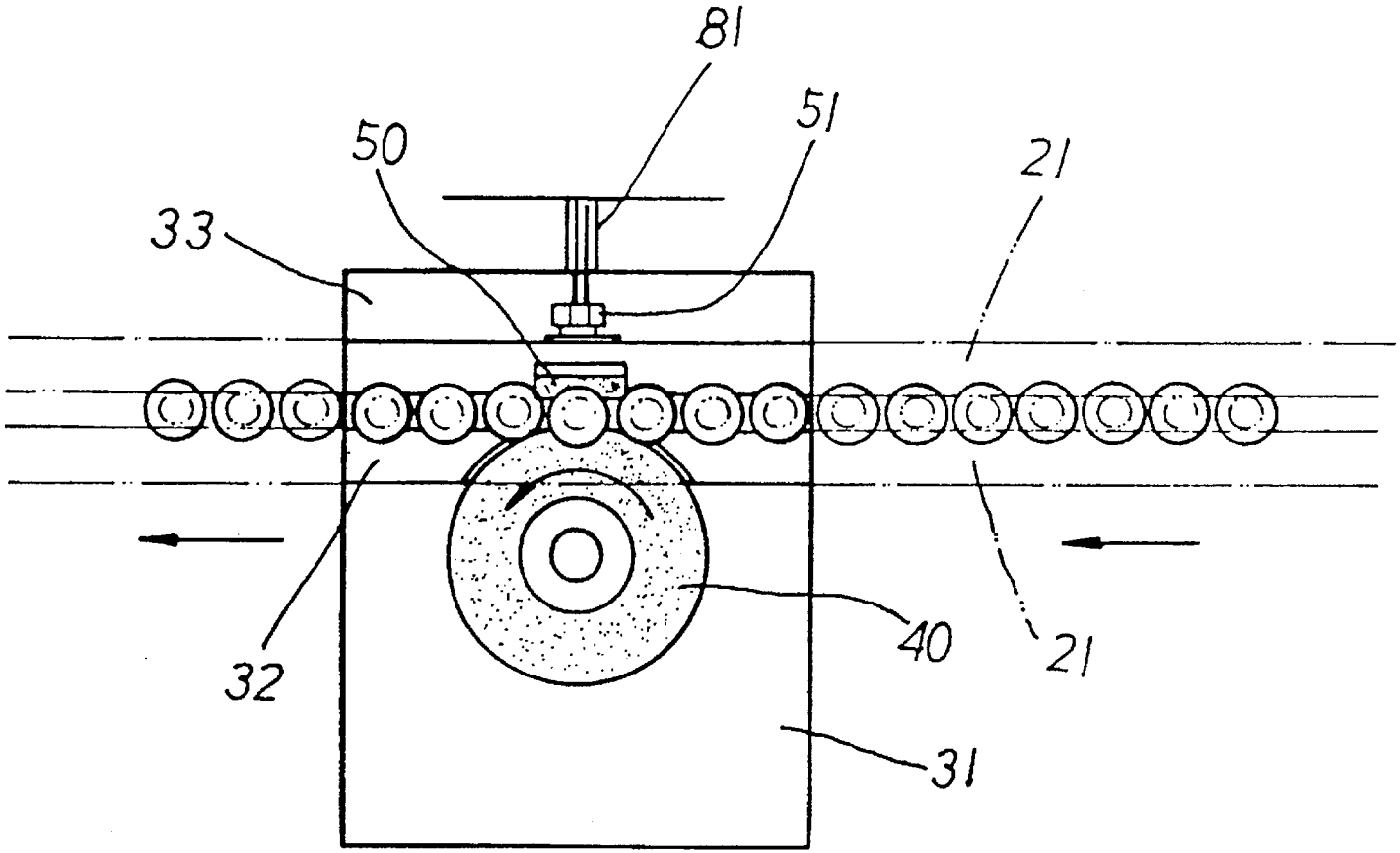
FIG. 7 shows the operation of the spot gluing machine of the present invention.

FIG. 7 shows the operation of the present invention, wherein the screws to be spot glued are placed into the vibrating body 10 and the vibrating body 10 vibrates to move the screws upward along the spiral slope 11 onto the horizontal conveying means 20. The head portion of each screw is restrained between the two conveying belts 21 of the conveying means on the upper faces thereof, while the stem portion of the screw hangs down between the two conveying belts 21. When the screw is conveyed by the conveying means 20 to a position between the rubber wheel 40 and the spot gluing plate 50, the rubber wheel 40 rotates to make the stem portion of the screw rotate so as to roll over the spot gluing plate 50 so as to complete the spot gluing operation. The rubber wheel 40 rotates at a speed corresponding to the conveying speed of the conveying means 20. After the spot gluing operation, the screw is continuously conveyed by the conveying means 20 to drop onto a lower conveying belt 90. The same procedure is repeated continuously.

According to the above arrangements, three advantages are achieved as follows:

1. The spot gluing operation is continuously performed so that the spot gluing speed is increased.
2. The distance between the two upright boards 32, 33 can be freely adjusted so as to suit screws with different diameters.
3. The stem portion of the screw is entirely spot glued around 360 degrees of its surface so that the quality and effect of the screw are better.

The above embodiment is only an example of the present invention and the scope of the present invention should not be limited to the example. Any modification or variation derived from the example should fall within the scope of the present invention.

I claim:

1. A gluing machine for applying glue around the periphery of a shank portion of a headed fastener comprising:

a) supply means for supplying a plurality of fasteners;

b) a conveyor for conveying a plurality of fasteners from the supply means, the conveyor comprising a pair of spaced apart endless belts having first runs moving at substantially the same speed so as to convey the fastener with the shank portions extending below the first runs between the spaced apart endless belts; and, c) a glue applying device for applying glue around the entire circumference of the shank of the fastener, the glue applying device comprising:

i) a pair of spaced apart upright boards forming a channel therebetween, the boards located immediately beneath the first runs of the spaced apart endless belts such that shanks of fasteners conveyed by the endless belts pass through the channel between the upright boards;

ii) a gluing plate attached to a first of the pair of upright boards so as to extend into the channel;

iii) glue supply means connected to the gluing plate to supply glue to the gluing plate;

iv) an arcuate notch in a second of the pair of upright boards; and, v) a rotatable wheel having a resilient peripheral surface, a portion of the wheel extending into the channel between the upright boards through the arcuate notch to contact the shanks of fasteners conveyed by the convey such that rotation of the wheel causes rotation of a fastener shank coming into contact with the wheel against the gluing pad so as to apply the glue around the entire periphery of shanks.

2. The gluing machine of claim 1 further comprising adjustable attaching means to attach the gluing pad to the first upright board such that the distance between the gluing pad and the first runs of the endless belts is adjustable.

3. The gluing machine of claim 1 further comprising:

a) an electric motor having a rotatable output shaft;

b) a control circuit connected to the electric motor for controlling the rotational speed of the motor; and c) adjustable mounting means for mounting the rotatable wheel on the output shaft of the electric motor such that the distance between the first runs of the endless belts and the rotatable wheel may be adjusted.

4. The gluing machine of claim 1 further comprising:

a) a base board; and, b) connecting means to adjustably connect the upright boards to the base board such that a width of the channel between the upright boards may be varied.

* * * * *